US008827231B1

(12) United States Patent
Blair

(10) Patent No.: US 8,827,231 B1
(45) Date of Patent: Sep. 9, 2014

(54) STANCHION FOR ANCHORING EXERCISE APPARATUS

(76) Inventor: Donald H. Blair, Point Pleasant, NJ (US)

( * ) Notice: Subject to any disclaimer, the term of this patent is extended or adjusted under 35 U.S.C. 154(b) by 0 days.

(21) Appl. No.: 13/414,798

(22) Filed: Mar. 8, 2012

Related U.S. Application Data

(60) Provisional application No. 61/464,751, filed on Mar. 9, 2011.

(51) Int. Cl.
*E04H 12/22* (2006.01)
*A63B 71/00* (2006.01)
*A63B 71/02* (2006.01)

(52) U.S. Cl.
CPC ..... *A63B 71/023* (2013.01); *E04H 12/2269* (2013.01); *A63B 71/028* (2013.01); *E04H 12/22* (2013.01)
USPC ..... 248/507; 52/698

(58) Field of Classification Search
CPC ..... A63B 71/023; A63B 71/028; A63B 2244/225; E04F 11/1812; E04H 17/22; E04H 12/22; E04H 12/2269
USPC ..... 248/499, 500, 502, 507, 508, 519, 537, 248/205.5; 256/1, 46, 47, 423, 65.14; 273/407; 473/423, 427, 469, 476–479, 473/481, 492–494; 52/169.13, 170, 698, 52/297, 298; 482/18, 33, 114, 118
See application file for complete search history.

(56) References Cited

U.S. PATENT DOCUMENTS

| | | | | | |
|---|---|---|---|---|---|
| 1,445,938 | A * | 2/1923 | Farrington | 52/295 |
| 1,459,723 | A * | 6/1923 | Eskell | 473/492 |
| 1,668,486 | A * | 5/1928 | Betts | 52/298 |
| 1,818,172 | A * | 8/1931 | Sutherland | 403/205 |
| 2,210,441 | A * | 8/1940 | Bachman | 52/297 |
| 2,573,086 | A * | 10/1951 | Yoshimoto, Sr. | 248/235 |
| 2,780,440 | A * | 2/1957 | Krieger | 256/21 |
| 3,082,578 | A * | 3/1963 | Lindstaedt et al. | 52/745.21 |
| 3,193,059 | A * | 7/1965 | Wallerstein, Jr. | 52/297 |
| 3,406,946 | A * | 10/1968 | Saultz | 256/19 |
| 3,420,013 | A * | 1/1969 | Alvarado | 52/161 |
| 3,612,287 | A * | 10/1971 | Maltese | 52/298 |
| 3,694,978 | A * | 10/1972 | Mintz | 52/166 |
| 3,880,405 | A * | 4/1975 | Brueske | 256/59 |
| 4,122,451 | A * | 10/1978 | Senoh | 473/492 |
| 4,240,766 | A * | 12/1980 | Smith et al. | 404/10 |
| 5,404,682 | A * | 4/1995 | West | 52/165 |
| 5,571,229 | A * | 11/1996 | Fitzsimmons et al. | 473/481 |
| 6,155,937 | A * | 12/2000 | Alter | 473/469 |
| 6,669,160 | B2 * | 12/2003 | Steinmetz et al. | 248/346.01 |
| 6,745,529 | B2 * | 6/2004 | Beltran | 52/297 |
| 6,966,530 | B2 * | 11/2005 | Hsu | 248/206.2 |
| 7,055,807 | B2 * | 6/2006 | Pesta | 256/65.14 |
| 7,237,305 | B2 * | 7/2007 | Newman et al. | 16/429 |
| 7,779,589 | B2 * | 8/2010 | Salman | 52/298 |

(Continued)

*Primary Examiner* — Jonathan Liu
*Assistant Examiner* — Guang H Guan
(74) *Attorney, Agent, or Firm* — Michael R. Philips

(57) ABSTRACT

A stanchion is provided for anchoring exercise apparatus that is removably secured in a floor mounted post socket. The stanchion is fitted with a cap ring at the upper end and a number of loops in the middle section thereof. A set of resilient members and a rigid washer are secured to the bottom of the stanchion for frictionally securing the stanchion. In use, a rope or elastic band is placed through a loop and the ends are manipulated by a user for exercise.

4 Claims, 2 Drawing Sheets

(56) References Cited

U.S. PATENT DOCUMENTS 7,930,859 B1 * 4/2011 Eslambolchi et al. ..... 52/103
8,177,185 B2 * 5/2012 Priegel ..... 248/539
2004/0206855 A1 * 10/2004 Caveney et al. ..... 248/68.1
2005/0121560 A1 * 6/2005 Slyter ..... 248/71
2007/0129185 A1 * 6/2007 Schank et al. ..... 473/492
2010/0281791 A1 * 11/2010 Intagliata et al. ..... 52/127.12

* cited by examiner

STANCHION FOR ANCHORING EXERCISE APPARATUS

RELATED APPLICATION

This application is a conversion of provisional application No. 61/464,751 filed on Mar. 9, 2011.

FIELD OF THE INVENTION

The present invention relates to the field of exercise equipment, and more particularly to devices for anchoring an end of long, flexible exercise apparatus such as ropes and elastic bands.

BACKGROUND OF THE INVENTION

A recent trend in exercise equipment has been to attach a portion of a heavy rope to a fixed anchoring point and alternately raising and lowering the free end of the rope by arm movements. The rope apparatus used for this exercise is known among fitness professionals as "battling ropes." The user of the rope apparatus either raises and lowers two rope ends in unison or in opposite timing, one rope going up while the other rope goes down. The exercise can be used to strengthen the shoulder muscles by moving the whole arm to raise and lower the ropes or strengthen the biceps and triceps by flexure and extension of the elbows. Use of these exercises has also been found to be beneficial to overall balance and stability by strengthening body core muscle groups. Current practice has been to attach the rope ends to wall mounted brackets or equipment holders. With multiple people using ropes for exercise simultaneously, each person is facing the wall and they are standing in a line.

While the description below is directed mainly to rope exercise equipment, elastic bands are also adaptable to the stanchion provided. In the case of elastic bands, the exercises involve extension of the bands to work arm, abdominal, back and leg muscle groups.

Many gyms, especially gyms in schools, have tubular sockets permanently set into the gym floor. The sockets are designed to hold the posts for supporting a volleyball net or similar device. The invention described below is adapted for being mounted in this type of post socket to allow the ropes or other exercise equipment to be anchored in the middle area of a gym floor to improve accessibility.

SUMMARY OF THE INVENTION

The stanchion provided allows multiple users to perform rope or elastic band exercises simultaneously while facing one another in the center area of a floor. The stanchion is configured for being removably anchored in a tubular socket in a gym floor. The stanchion has resilient, compressible fittings at its lower end for securely engaging the socket. A number of connector loops are provided around the stanchion post for attachment of a rope or elastic band. When the exercise session is completed, the stanchion may be removed from the socket and stored.

DESCRIPTION OF THE PREFERRED EMBODIMENT

Figure 1:
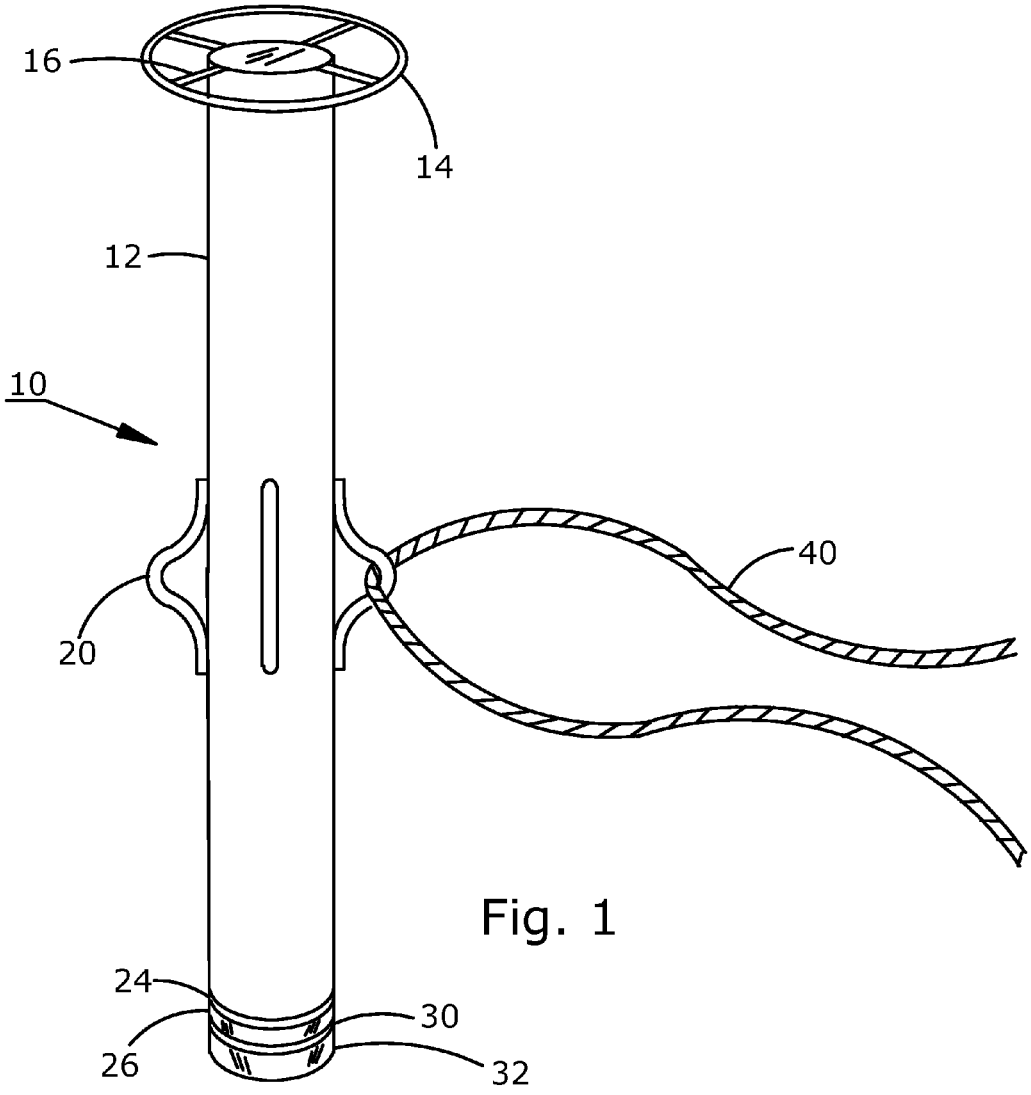
FIG. 1 is a perspective view of the stanchion of the present invention with a rope anchored thereto.

Referring to FIG. 1, a stanchion 10 of the present invention is illustrated in perspective view with a "battling rope" 40 anchored to a loop 20 that is affixed to post 12. In the stanchion 10 shown, four loops 20 are fixedly mounted to post 12 in angularly dispersed locations. Loops 20 may be configured in any shape that will receive and hold a rope 40. Rope 40 is typically on the order of 5.0 cm (2.0 inches) in diameter, and each loop 20 is sized to slidingly receive rope 40. Alternate numbers of loops 20, e.g. two or five loops, are equally useful within the spirit and scope of the invention. A cap ring 14 is supported at the upper end of post 12 by a plurality of spokes 16. In addition to loops 20, cap ring 14 may be sized to receive a rope 40 in each open section between adjacent spokes 16.

Referring further to FIG. 1, post 12, cap ring 14 and loops 20 are preferably formed of substantially rigid material, e.g. iron or aluminum, post 12 being in the form of a round tube. Forming these components of metal allows construction to be accomplished primarily by welding for efficiency and permanence. Post 12 has a diameter sized to slidingly fit into a floor-mounted socket as is available in many gyms to support posts for a volleyball net, as will be discussed below.

Continuing with FIG. 1, a metallic plug 24 is fixedly mounted to the bottom end of post 12, preferably by welding. A resilient pad 26 is positioned in contact with the lower surface of plug 24. A rigid washer 30 is held in contact with the lower surface of pad 26, and a resilient cushion 32 is held in contact with the lower surface of washer 30. Washer 30 is preferably formed of stamped steel. Pad 26 and cushion 32 are preferably formed of a resilient material, e.g. rubber or polyurethane. Cushion 32, washer 30 and pad 26 are held in position by a fastener (not visible in this view), to be described below. Cushion 32 is resilient in order to prevent the bottom of stanchion 10 of the invention from damaging a floor surface such as exists in most gyms.

Figure 2:
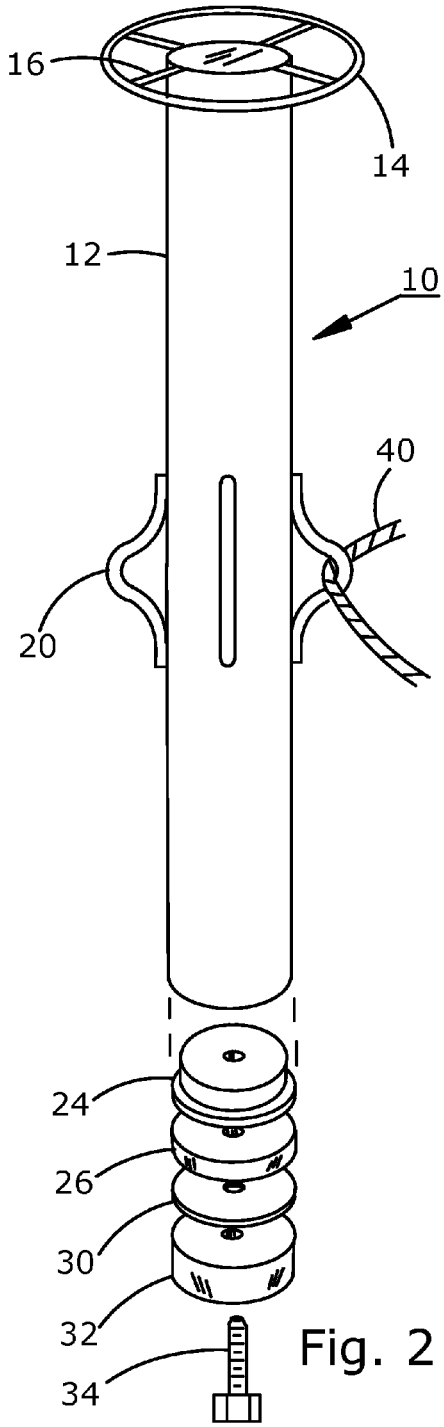
FIG. 2 is an exploded perspective view of the stanchion shown in FIG. 1.

Referring now to FIG. 2, stanchion 10 is shown in an exploded perspective view. Loops 20 are fixedly attached at the approximate mid-height of post 12, with cap ring 14 at the top thereof. Plug 24 is formed with an upper portion sized to match the inside diameter of post 12 and a flange at the lower end of plug 24 sized to match the outside diameter of post 12. Plug 24 is formed with a central hole having internal threads to receive a fastener 34, e.g. a machine bolt. Alternately, plug 24 may be formed with an outside diameter sized to fit within the bottom of post 12 and be welded in position. Pad 26, washer 30 and cushion 32 are shown in sequence immediately below plug 24, each having a matching central hole. Fastener 34 is provided to be passed through the central holes in cushion 32, washer 30 and pad 26 to anchor into the threaded hole in the center of plug 24. Fastener 34 has a diameter to snugly engage the inside diameter of cushion 32 and pad 26.

Figure 3:
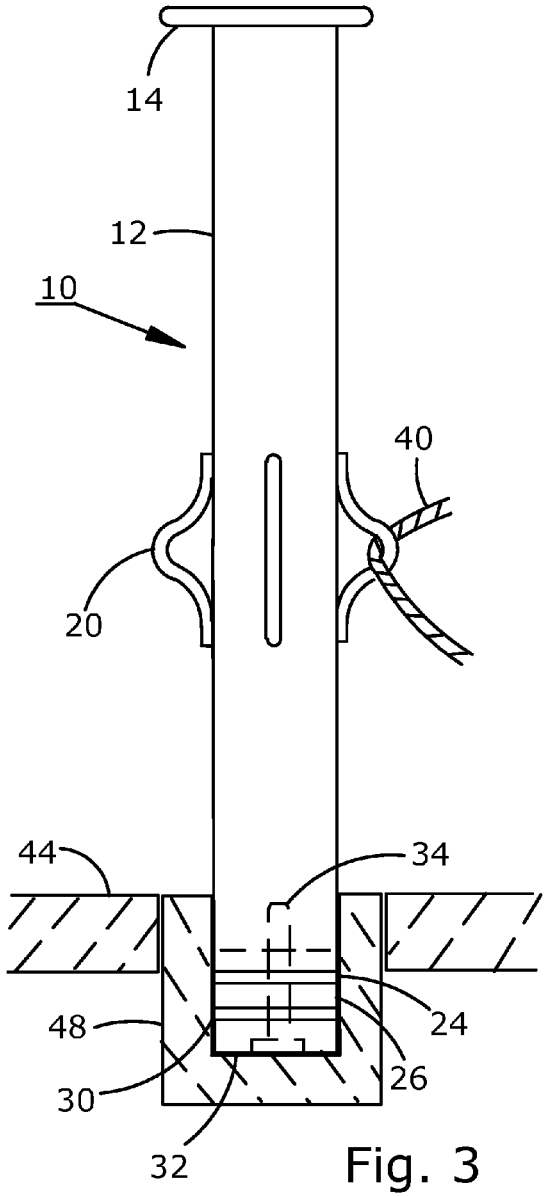
FIG. 3 is a side elevation view of the invention stanchion fitted into a socket mounted into a floor.

Referring now to FIG. 3, stanchion 10 is shown in front elevation view in assembled condition. Plug 24 is welded into the bottom of post 12 with the flange of plug 24 congruent with the outside diameter of post 12. The outside diameters of post 12, plug 24 and washer 30 are configured to fit slidingly within a socket 48 that is fixedly mounted in a floor 44. When the bottom of stanchion 10 is placed into socket 48 in gym floor 44, the outside diameters of pad 26 and cushion 32 snugly engage the inside diameter of socket 48. As illustrated, a cavity is formed in the lower surface of cushion 32, the cavity configured to enclose the head of fastener 34 and further prevent damage to the gym floor.

Referring further to FIG. 3, post 12 is seen positioned with cushion 32 in contact with the bottom of floor socket 48. Post 12 is now rotated clockwise to more firmly engage fastener 34 into plug 24, simultaneously compressing resilient pad 26 and resilient cushion 32. Pad 26 and cushion 32 resist rotation relative to floor socket 48, and fastener 34 resists rotation relative to pad 26 and cushion 32. Therefore, fastener 34 is pulled further into the threaded hole in plug 24 in a manner to axially compress resilient pad 26 and cushion 32 and cause radial expansion, thereby forming a tight grip against the interior wall of floor socket 48. A sufficient length of post 12 is held in the floor socket to prevent stanchion 10 from tipping. At the completion of the exercise session, stanchion 10 may be removed from floor socket 48 by rotating post 12 in the opposite direction (counterclockwise) and lifting stanchion 10 upward. Alternate types of lock member may be substituted for the compressible, resilient pad and cushion members described herein.

In an alternate utilization of the stanchion for anchoring exercise equipment of the invention, elastic cords or bands may be used in place of the rope described above. Exercises such as bicep lifts, shoulder lifts and triceps extensions may be practiced with the cord or band attached to either cap ring 14 or loops 20.

While the description above discloses preferred embodiments of the present invention, it is contemplated that numerous variations and modifications of the invention are possible and are considered to be within the scope of the claims that follow.

What is claimed is:

1. A stanchion for anchoring an exercise apparatus, comprising:

a. a post having a plurality of loops mounted thereto and having a bottom end sized for being slidingly inserted into a floor socket;

b. a plug mounted to the bottom end of the post, the plug formed with a central threaded hole with internal threads;

c. a resilient pad assembled adjacent to and concentric with the plug, the pad formed with a central hole;

d. a washer assembled adjacent to and concentric with the pad, the washer formed with a central hole;

e. a resilient cushion assembled adjacent to and concentric with the washer, the cushion formed with a central hole;

f. the resilient pad and the resilient cushion being formed of a resilient material to expand radially when compressed axially and to shrink radially when axial pressure is released in order to remove the post from the floor socket; and g. an externally threaded fastener having fastener threads and a shank outside diameter sized for snugly engaging the central holes in the cushion and the pad, the fastener threads engaging the internal threads in the central threaded hole in the plug;

h. whereas the resilient pad is configured to frictionally engage an inside diameter of the floor socket when the post is rotated, causing the fastener to resist rotation and to drive the fastener into the central threaded hole in the plug, thereby compressing the pad and the cushion axially and expanding the pad and the cushion radially to press against the inside diameter of the floor socket.

2. The stanchion described in claim 1, wherein the cushion is formed with a recess concentric with the central hole in the cushion, the recess configured to enclose a head portion of the fastener.

3. The stanchion described in claim 1, wherein the loops extend radially outwardly from the post.

4. The stanchion described in claim 1, further comprising a cap ring mounted to an upper end of the post, the cap ring formed with a plurality of openings.

* * * * *